US007926456B2

(12) United States Patent
Park

(10) Patent No.: US 7,926,456 B2
(45) Date of Patent: Apr. 19, 2011

(54) CONTINUOUS VARIABLE VALVE LIFT SYSTEM

(75) Inventor: Dongheon Park, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 356 days.

(21) Appl. No.: 12/166,683

(22) Filed: Jul. 2, 2008

(65) Prior Publication Data

US 2009/0151665 A1 Jun. 18, 2009

(30) Foreign Application Priority Data

Dec. 14, 2007 (FR) ..... 10-2007-0131567

(51) Int. Cl.
*F01L 1/34* (2006.01)

(52) U.S. Cl. ..... 123/90.16; 123/90.15; 123/90.39; 74/569

(58) Field of Classification Search ..... 123/90.15, 123/90.16, 90.39; 74/559, 569
See application file for complete search history.

(56) References Cited

U.S. PATENT DOCUMENTS 6,425,357 B2 * 7/2002 Shimizu et al. ..... 123/90.16
6,907,852 B2 * 6/2005 Schleusener et al. ..... 123/90.16
2006/0207532 A1 * 9/2006 Fujita et al. ..... 123/90.16

* cited by examiner

*Primary Examiner* — Zelalem Eshete
(74) *Attorney, Agent, or Firm* — Morgan, Lewis & Bockius LLP

(57) ABSTRACT

A continuously variable valve lift system according to an exemplary embodiment of the present invention includes an input cam, a drive shaft, a lifter including a contact portion and pivoting around the drive shaft in response to a rotation of the input cam, a valve unit, an output cam that contacts the contact portion, pivots around the drive shaft, and opens the valve unit, a return spring supplying restoring force to the output cam, and an adjusting unit adjusting a distance between the drive shaft and the contact portion.

14 Claims, 6 Drawing Sheets

CONTINUOUS VARIABLE VALVE LIFT SYSTEM

CROSS-REFERENCE TO RELATED APPLICATION

This application claims priority to and the benefit of Korean Patent Application No. 10-2007-0131567 filed in the Korean Intellectual Property Office on Dec. 14, 2007, the entire contents of which are incorporated herein by reference.

BACKGROUND OF THE INVENTION (a) Field of the Invention

The present invention relates to a continuously variable valve lift system. More particularly, the present invention relates to a continuously variable valve lift system that may include a lifter and a drive shaft, and may adjust valve lift by adjusting a distance between the lifter and the drive shaft.

(b) Description of the Related Art

A typical combustion chamber of an automotive engine is provided with an intake valve for supplying an air/fuel mixture and an exhaust valve for expelling burned gas. The intake and exhaust valves are opened and closed by a valve lift apparatus connected to a crankshaft.

A conventional valve lift apparatus has a fixed valve lift amount due to a fixed cam shape. Therefore, it is impossible to adjust the amount of a gas that is being introduced or exhausted.

If the valve lift apparatus is designed for low driving speeds, the valve open time and amount are not sufficient for high speeds. On the other hand, if the valve lift apparatus is designed for high speeds, the opposite is true.

The above information disclosed in this Background section is only for enhancement of understanding of the background of the invention and therefore it may contain information that does not form the prior art that is already known in this country to a person of ordinary skill in the art.

SUMMARY OF THE INVENTION

Embodiments of the present invention provide to a continuously variable valve lift system that may include a lifter and a drive shaft, and may adjust valve lift by adjusting a distance between the lifter and the drive shaft.

A continuously variable valve lift system according to an exemplary embodiment of the present invention may include an input cam; a drive shaft positioned substantially in parallel with the input cam; a lifter disposed at the drive shaft and pivoting around the drive shaft in response to a rotation of the input cam; an output cam disposed at the drive shaft coaxially with the lifter and pivoting around the drive shaft, the output cam comprising a contact portion and a lift activation portion; a valve unit configured to be opened or closed by the lift activation portion of the output cam; a return spring supplying restoring force to the contact portion of the output cam; and an adjusting unit disposed substantially at the drive shaft and adjusting a distance between the drive shaft and a contact point formed between the adjusting unit and the contact portion of the output cam.

The lifter may comprise a first hand and a second hand, wherein an angle between the first hand and the second hand is obtuse and a distal end portion of the first hand is substantially above the drive shift.

The adjusting unit may comprise an input shaft comprising a first slot formed along a longitudinal direction thereof and disposed within the drive shaft; a controlling unit connected with the input shaft and selectively rotating the input shaft; at least a moving shaft positioned in the input shaft, a protrusion of the moving shaft movably disposed to the first slot; at least a second slot formed to the drive shaft, the second slot inclining with a predetermined angle with respect to a longitudinal direction of the drive shaft, wherein the protrusion of the moving shaft is inserted through the second slot; at least a side body comprising a mounting portion and a first wedge portion, the side body movable along a longitudinal direction of the drive shaft and including a third slot formed at a circumference of the mounting portion enclosing a portion of the drive shaft, wherein the protrusion of the moving shaft is inserted through the third slot; and an upper body contacting the contact portion of the output cam, the upper body movable from or to the drive shaft according to movement of the side body, wherein the upper body comprises a mounting body and a second wedge portion and a shaft hole is formed at the mounting body in a longitudinal direction of the mounting body.

The inclining direction of the second slots may be opposite to each other

The first wedge portion of the side body may be configured to have a one-side wedge and the second wedge portion of the upper body may be configured to have at least two-side wedge.

a first connecting portion is inclininglyformed to the first wedge portion of the side body, a second connecting portion is inclininglyformed to the second wedge portion of the upper body, and the second connecting portion is slidably connected with the first connecting portion.

The first connecting portion and the second connecting portion may include at least a spline respectively. The splines of the first connecting portion and the second connecting portion may be shaped of trapezoid.

The adjusting unit may further include at least one transfer roller.

A transfer shaft may connect the transfer roller and the lifter through the shaft hole of the upper body and a fourth slot formed on the lifter, wherein the transfer shaft is movable along the fourth slot. The fourth slot may be formed on the first hand of the lifter in a longitudinal direction thereof at distal end portion of the first hand of the lifter. The fourth slot may be positioned substantially above the drive shaft.

An input roller may be disposed to a portion that the input cam contacts. The input roller may be disposed to a distal end portion of the second hand of lifter.

The controlling unit may comprise a controlling motor.

A continuously variable valve lift system according to an exemplary embodiment of the present invention may adjust valve lift and lift timing without excessive changing shapes of a cam and a valve train.

A continuously variable valve lift system according to an exemplary embodiment of the present invention may adjust valve lift without a hydraulic pressure apparatus so that a hydraulic circuit design is not needed.

REPRESENTATIVE REFERENCE NUMERALS

Figure 1:
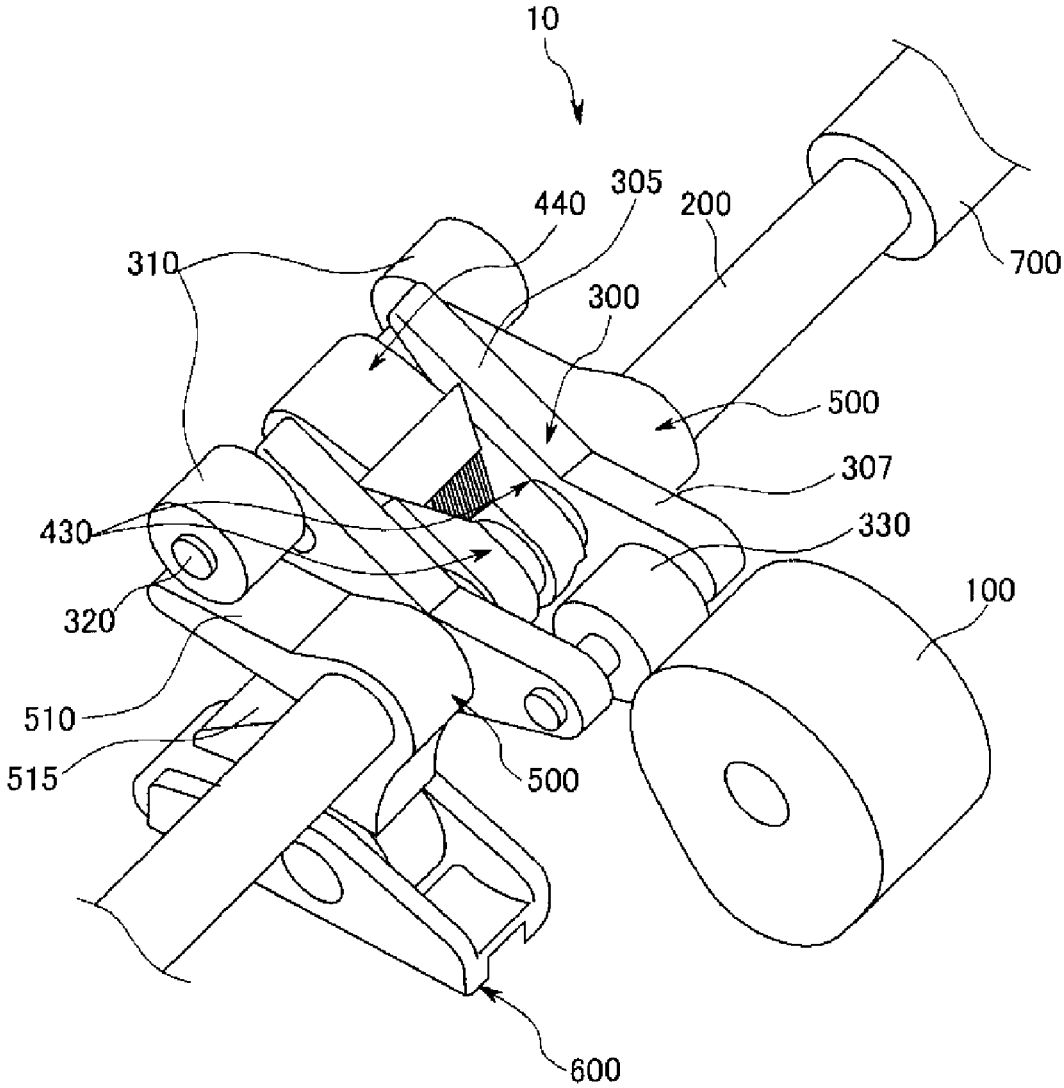
FIG. 1 is a perspective view of a continuously variable valve lift system according to an exemplary embodiment of the present invention.

10: continuously variable valve lift system
100: cam
200: drive shaft
300: lifter
310: transfer roller
320: transfer shaft
330: input roller
410: input shaft
420: moving shaft
430: side body
431: first connecting portion
440: upper body
441: second connecting portion
500: output cam
510: contact portion
520: output cam base
530: return spring
600: valve unit
700: controlling motor
801: first slot
802: second slot
803: third slot
804: fourth slot

DETAILED DESCRIPTION OF THE EMBODIMENTS

An exemplary embodiment of the present invention will hereinafter be described in detail with reference to the accompanying drawings.

Hereinafter, referring to FIG. 1, FIG. 4, FIG. 5, and FIG. 6, a scheme of a continuously variable valve lift system according to an exemplary embodiment of the present invention will be explained.

A continuously variable valve lift system 10 according to an exemplary embodiment of the present invention includes an input cam 100, a drive shaft 200, and a lifter 300 disposed at the drive shaft 200.

Figure 2:
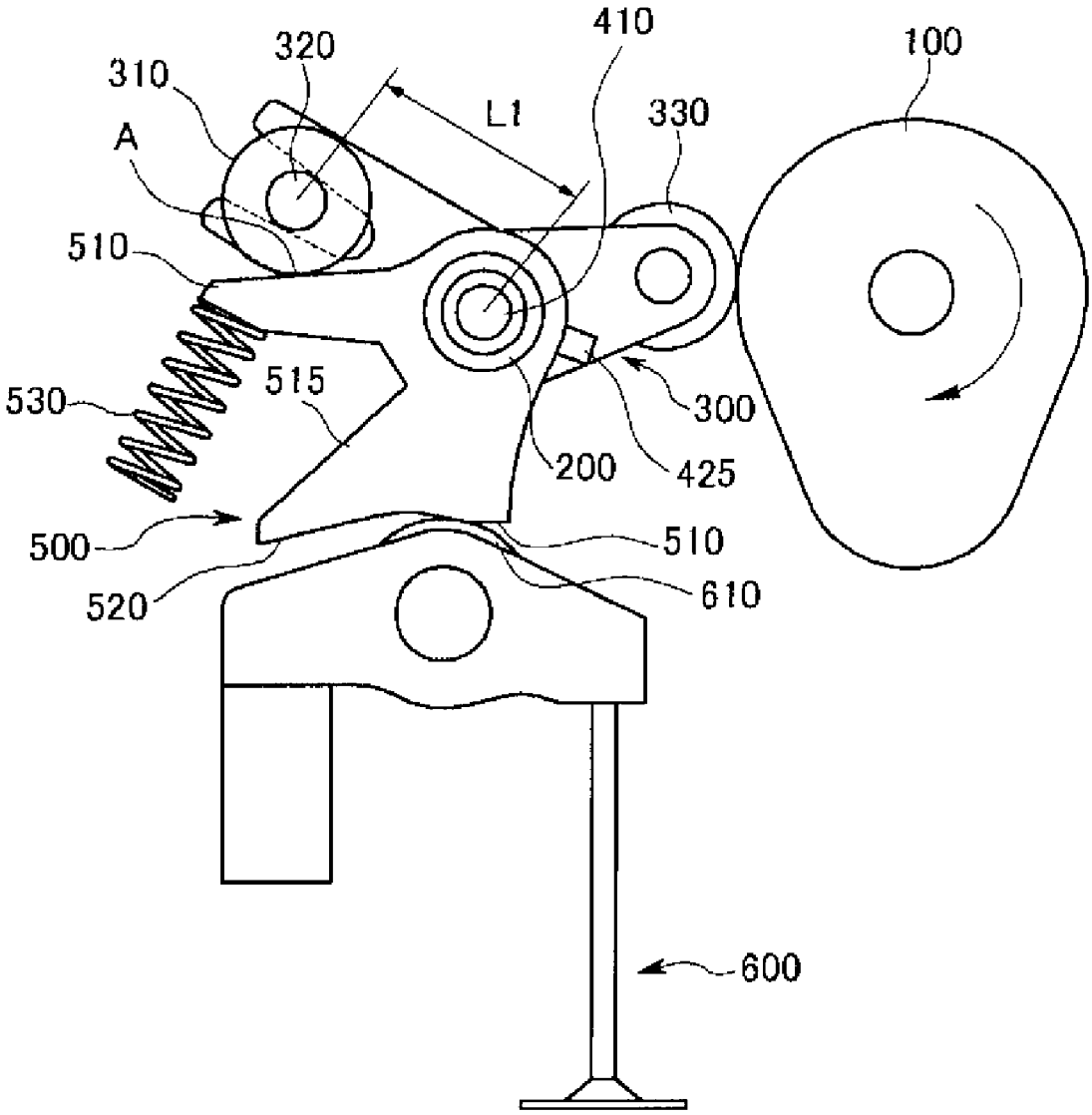
FIG. 2 illustrates an operation of a continuously variable valve lift system according to an exemplary embodiment of the present invention in a high lift mode.

The continuously variable valve lift system 10 also includes an output cam 500. The output cam 500 including a contact portion 510 and a lift activation portion 515 pivots around the drive shaft 200 in response to a rotation of the input cam 100, and opens or closes a valve unit 600. A return spring 530, as shown in FIG. 2, is disposed under the contact portion 510 of the output cam 500 for supplying restoring force to the output cam 500.

The continuously variable valve lift system 10 further comprises an adjusting unit for adjusting a distance between the drive shaft 200 and a contact point A positioned on the contact portion 510.

Figure 5:
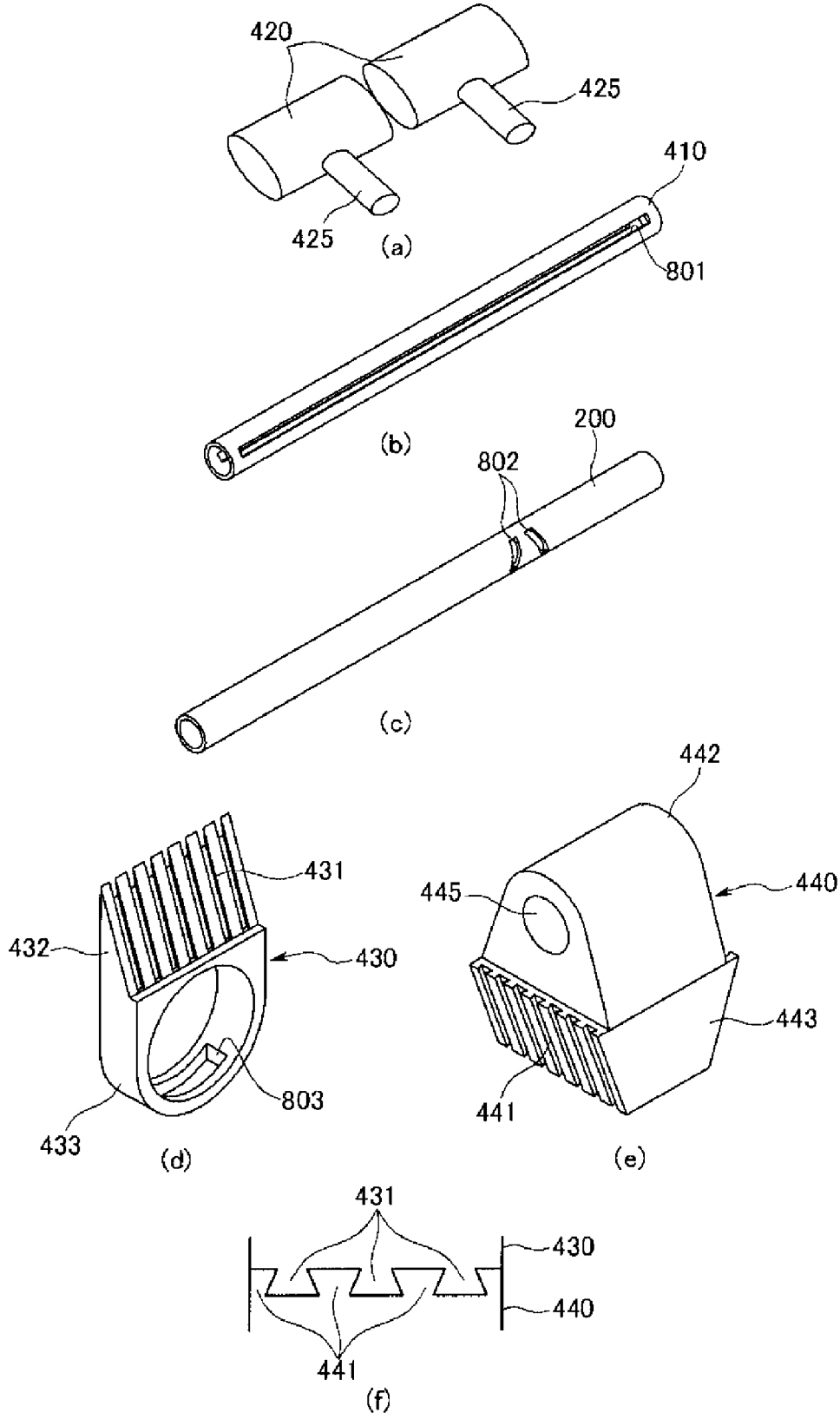
FIG. 5(*a*) to (*f*) are drawings showing elements of an adjusting unit of a continuously variable valve lift system according to an exemplary embodiment of the present invention.

Referring to FIG. 5(*b*), the adjusting unit includes an input shaft 410 in which a first slot 801 is formed along a longitudinal direction thereof and that is disposed within the drive shaft 200, and a controlling unit is connected with a distal end of the input shaft 410 for rotating the input shaft 410 within the drive shaft 200.

Referring to FIG. 5(*a*), at least one moving shaft 420 including a protrusion 425 is movably disposed to the first slot 801. In other words, the protrusion 425 of the moving shaft 420 is slidably inserted into the first slot 801.

Further, referring to FIG. 5(*c*), at least a second slot 802 is formed to the drive shaft 200 inclininglyy with a predetermined angle with respect to a longitudinal direction of the drive shaft 200, and the protrusion 425 of the moving shaft 420 movably disposed in the input shaft 410 is inserted through the second slot 802 of the drive shaft 200. The inclining directions of the second slots 802 may be opposite to each other in an exemplary embodiment of the present invention. That is, a distance between upper portions of the second slots 802 may be narrower than s distance between lower portions of the second slots 802.

Figure 4:
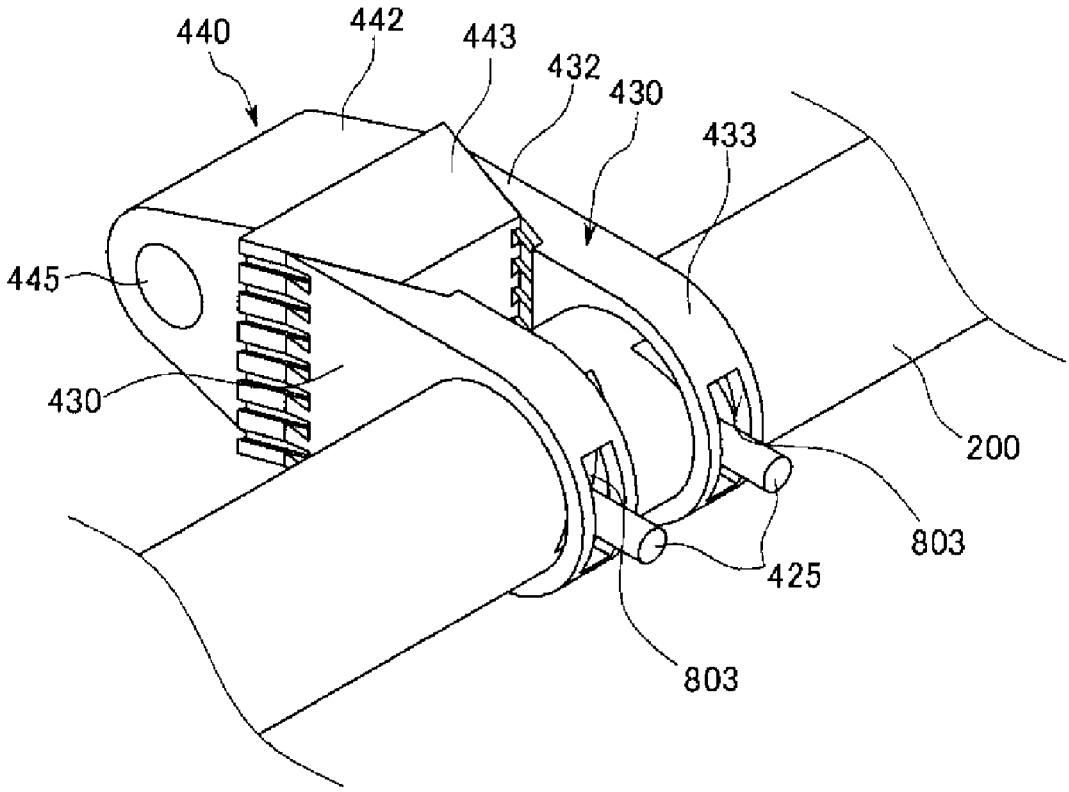
FIG. 4 illustrates connection of a drive shaft and a side body of a continuously variable valve lift system according to an exemplary embodiment of the present invention.

Referring to FIG. 4 and FIG. 5(*d*), at least a side body 430 that is movable along a longitudinal direction of the drive shaft 200 is disposed to the drive shaft 200.

The side body 430 comprises a wedge portion 432 and a mounting portion 433. A third slot 803 is formed to the mounting portion 433 along a circumference direction thereof for the protrusions 425 of the moving shaft 420 to be inserted therethrough.

Referring to FIG. 4 and FIG. 5(*e*), an upper body 440 comprises a mounting body 442 and a wedge portion 443 and a shaft hole 445 is formed at the mounting body 442 along a longitudinal direction of the mounting body 442. The wedge portion 443 of the upper body 440 is slidably coupled with the wedge portion 432 of the side bodies 430 and changes a distance between the drive shaft 200 and a contact point A positioned on the contact portion 510 in response to movement of the at least one side body 430 as explained later in detail.

Referring to FIG. 4, FIG. 5(*d*), FIG. 5(*e*), and FIG. 5(*f*), the wedge portion 432 of the at least one side body 430 may be shaped of one-side wedge and a first connecting portion 431 is inclininglyy formed to the wedge portion 432 of the at least one side body 430. The wedge portion 443 of the upper body 440 may be shaped of two-side wedge and a second connecting portion 441 is inclininglyy formed to the wedge portion 443 of the upper body 440.

The first connecting portion 431 and the second connecting portion 441 comprise at least a spline to be engaged each other. From this configuration, the second connecting portion 441 of the upper body 440 is slidably connected with the first connecting portion 431 of the side body 430 through splines thereof wherein the splines of the first connecting portion 431 and the second connecting portion 441 are complementarily convex each other. In an exemplary embodiment of the present invention the splines may be shaped of a trapezoid such that each splines are not separate from each other except for the longitudinal direction of the splines As a result, as a distance between the side bodies 430 is controlled, a distance between the upper body 440 and the drive shaft 200 becomes regulated as explained hereinafter.

Figure 3:
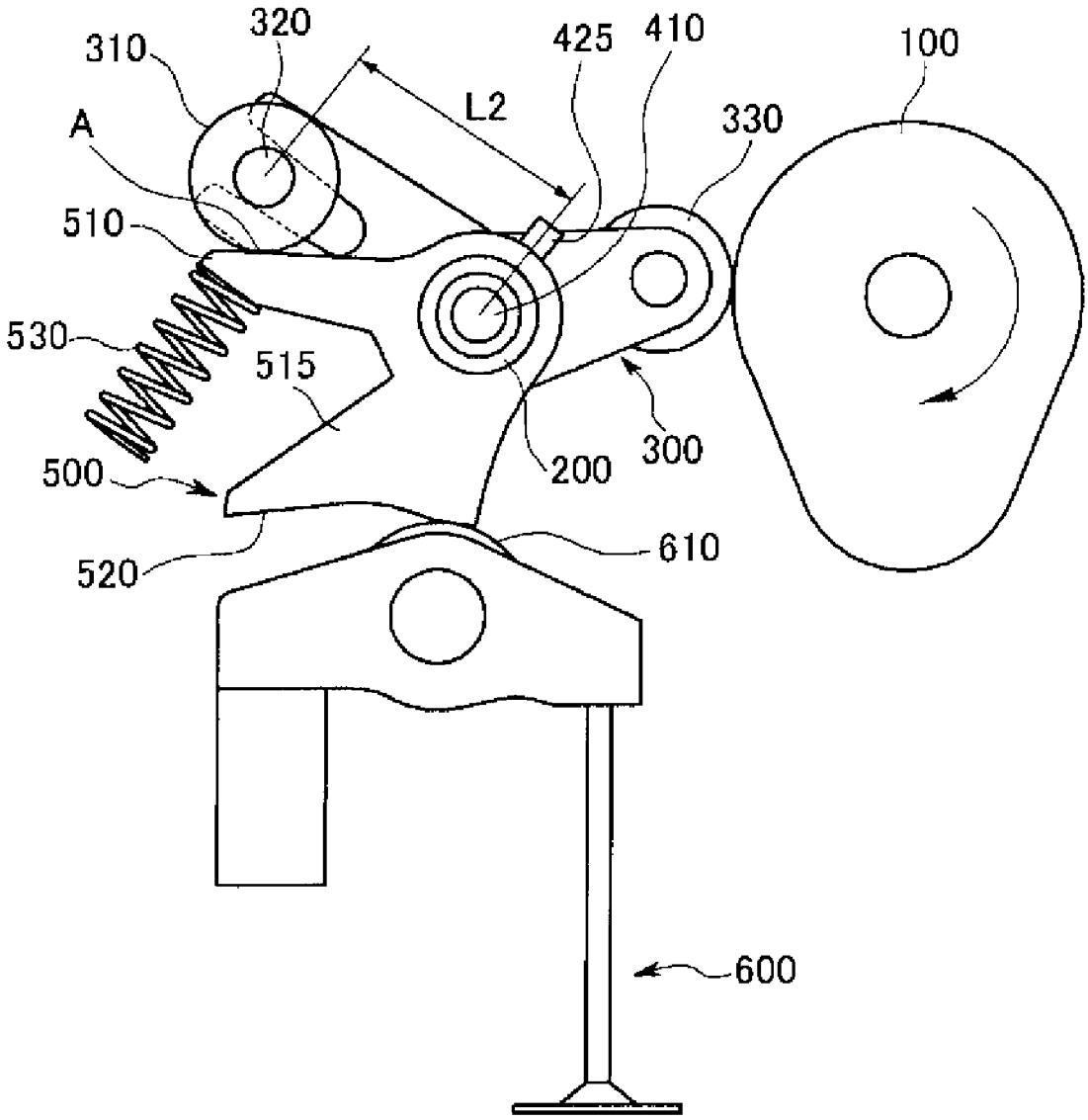
FIG. 3 illustrates an operation of a continuously variable valve lift system according to an exemplary embodiment of the present invention in a low lift mode.

Referring to FIGS. 1-3, the lifter 300 comprises a first hand 305 and a second hand 307 to form a V shape. The angle between the first hand 305 and the second hand 307 is obtuse and the distal end portion of the first hand 305 is positioned above the drive shaft 200. The lifter 300 is positioned next to the side bodies 430 and pivotally coupled to the drive shaft 200. An input roller 330 is positioned a distal end portion of the second hand 307 of the lifter 300 and the input roller 330 is pivotally activated by rotation of the cam 100.

Figure 6:
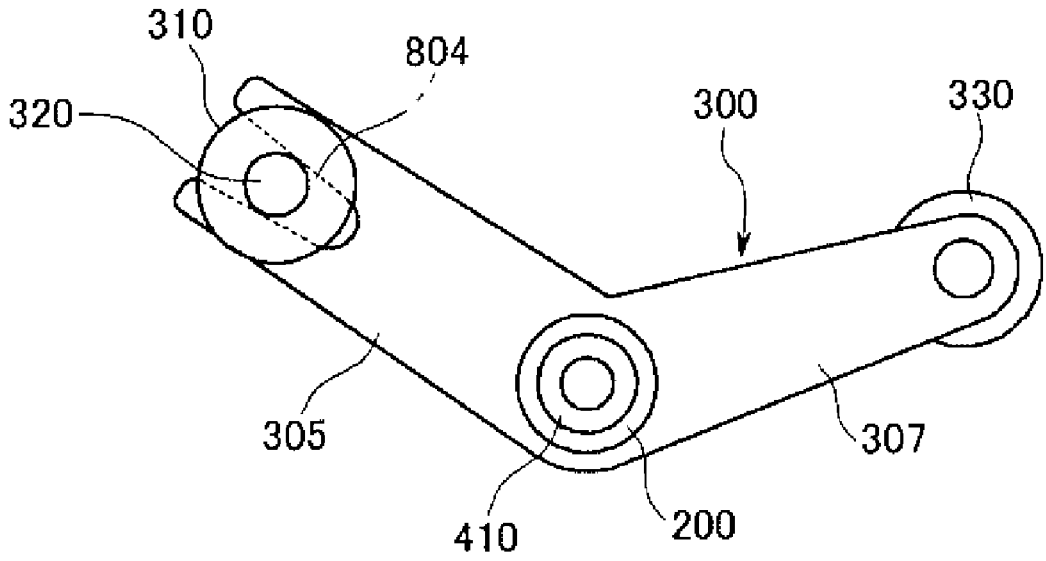
FIG. 6 illustrates a lifter of a continuously variable valve lift system according to an exemplary embodiment of the present invention.

Referring to FIG. 6, a fourth slot 804 is formed to a distal end portion of the first hand 305 of the lifter 300 along a longitudinal direction of the first hand 305. A transfer shaft 320 is inserted through the fourth slot 804 of the first hand 305 and through the shaft hole 445 of the upper body 440 to couple the upper body 440 and the lifter 300. The transfer shaft 320 can slidably move along the fourth slot 804 according to change of lift mode as explained the next and makes a point-contact with the contact portion 510 of the output cam 500.

An input roller 330 is disposed to distal end portion of the second hand 307 of the lifter 300. At this configuration, the input roller 330 is positioned opposite to the transfer roller 310 with respect to the drive shaft 200 and the transfer roller 310 is positioned above the drive shaft 200.

The distance between the side bodies 430 can be changed by rotating the protrusions 425 of the moving shaft 420 along the second slots 802 of the drive shaft 200 which are inclingly formed at the drive shaft 200.

In an exemplary embodiment of the present invention, referring to FIG.4 again, as the protrusions 425 of the moving shaft 420 rotates downwards along the second slots 802 of the drive shaft 200, the moving shaft 420 moves outwards along the first slot 801 of the input shaft 410 and thus drives the side bodies 430 outwards. Since the transfer roller 310 is positioned above the drive shaft 200, the upper body 440 slidably moves downward to the drive shaft 200 as the transfer shaft 320 moves along the fourth slot 804 of the lifter 300. As a result, the distance between the upper body 440 and the drive shaft 200 becomes closer.

In contrast, as the protrusions 425 of the moving shaft 420 moves upwards along the second slots 802 of the drive shaft 200, the moving shaft 420 moves inwards along the first slot 801 of the input shaft 410 and thus pushes the side bodies 430 inwards. As a result, the side bodies 430 push the upper body 440 outwards and thus the transfer shaft 320 moves upwards along the fourth slot 804 of the lifter 300. As a result the distance between the upper body 440 and the drive shaft 200 becomes larger.

Referring to FIG. 1, a controlling unit includes a controlling motor 700 connected with the input shaft 410 for controlling rotation of the input shaft 410 configured within the drive shaft 200.

Hereinafter, referring to FIG. 2, FIG. 3, and FIG. 5, as the cam 100 rotates clockwise, an operation to the continuously variable valve lift system according to an exemplary embodiment of the present invention will be explained.

In FIG.2, for high lift mode, the input shaft 410 is rotated clockwise in the drawing, and thus the moving shafts 420 become more distant from each other in a high lift mode. In other words, the side bodies 430 coupled with the moving shaft 420 via the second slots 802 and the protrusions 425 become more distant, and thus the upper bodies 440 slidably connected with the side bodies 430 become relatively close to the drive shaft 200 as the upper body 440 positioned above the drive shaft 200 slidably moves downwards to the drive shaft 200 along the fourth slot 804 of the lifter 300. Accordingly, the contact point A positioned on the contact portion 510 moves towards the drive shaft 200.

In the drawing, L1 indicates a distance between centers of the drive shaft 200 and the transfer roller 310 in a high lift mode.

As the cam 100 rotates clockwise, the lifter 300 pivots around the drive shaft 200 in response to a rotation of the cam 100. As a result the lifter 300 activates the output cam 500 and the valve unit 600 is opened and closed as high lift.

Referring to FIG. 3, for the low lift mode, the input shaft 410 rotates counterclockwise and thus the side bodies 430 coupled with the moving shafts 420 via the second slots 802 and the protrusions 425 become close and the upper bodies 440 slidably connected with the side bodies 430 become relatively more distant from the drive shaft 200 as the upper body 440 positioned above the drive shaft 200 slidably moves upwards to the drive shaft 200 along the fourth slot 804 of the lifter 300. Accordingly, the contact point A positioned on the contact portion 510 moves toward a distal end portion of the contact portion 510.

In the drawings, L2 indicates a distance between a center of the drive shaft 200 and the transfer roller 310 in a low lift mode, and L2 is longer than L1.

The lifter 300 pivots around the drive shaft 200 in response to a rotation of the cam 100. As a result the lifter 300 activates the output cam 500 and the valve unit 600 is opened and closed as low lift.

If the shape of the output cam base 520 contacting a swing arm roller 610 is modified, CDA (cylinder deactivation) may be realized.

The shape of the output cam base 520 may be determined according to a position of the swing arm roller 610, a length of the lifter 300, and so on, and the determination of the shape of the output cam base 520 may be obvious to a skilled person in the art referring to the description, so a detailed explanation thereof will be omitted.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A continuously variable valve lift system comprising:

an input cam;

a drive shaft positioned substantially in parallel with the input cam;

a lifter disposed at the drive shaft and pivoting around the drive shaft in response to a rotation of the input cam;

an output cam disposed at the drive shaft coaxially with the lifter and pivoting around the drive shaft, the output cam comprising a contact portion and a lift activation portion;

a valve unit configured to be opened or closed by the lift activation portion of the output cam;

a return spring supplying restoring force to the contact portion of the output cam; and an adjusting unit disposed substantially at the drive shaft and adjusting a distance between the drive shaft and a contact point formed between the adjusting unit and the contact portion of the output cam;

wherein the lifter comprises a first hand and a second hand, wherein an angle between the first hand and the second hand is obtuse and a distal end portion of the first hand is substantially above the drive shift; and wherein the adjusting unit comprises:

an input shaft comprising a first slot formed along a longitudinal direction thereof and disposed within the drive shaft;

a controlling unit connected with the input shaft and selectively rotating the input shaft;

at least a moving shaft positioned in the input shaft, a protrusion of the moving shaft movably disposed to the first slot;

at least a second slot formed to the drive shaft, the second slot inclining with a predetermined angle with respect to a longitudinal direction of the drive shaft, wherein the protrusion of the moving shaft is inserted through the second slot;

at least a side body comprising a mounting portion and a first wedge portion, the side body movable along a longitudinal direction of the drive shaft and including a third slot formed at a circumference of the mounting portion enclosing a portion of the drive shaft, wherein the protrusion of the moving shaft is inserted through the third slot; and an upper body contacting the contact portion of the output cam, the upper body movable from or to the drive shaft according to movement of the side body, wherein the upper body comprises a mounting body and a second wedge portion and a shaft hole is formed at the mounting body in a longitudinal direction of the mounting body.

2. The continuously variable valve lift system of claim 1, wherein the inclining direction of the second slots are opposite to each other.

3. The continuously variable valve lift system of claim 1, wherein the first wedge portion of the side body is configured to have a one-side wedge.

4. The continuously variable valve lift system of claim 1, wherein the second wedge portion of the upper body is configured to have at least two-side wedge.

5. The continuously variable valve lift system of claim 1, wherein a first connecting portion is incliningly formed to the first wedge portion of the side body, a second connecting portion is incliningly formed to the second wedge portion of the upper body, and the second connecting portion is slidably connected with the first connecting portion.

6. The continuously variable valve lift system of claim 5, wherein the first connecting portion and the second connecting portion include at least a spline respectively.

7. The continuously variable valve lift system of claim 6, wherein the splines of the first connecting portion and the second connecting portion are shaped of trapezoid.

8. The continuously variable valve lift system of claim 1, wherein the adjusting unit further includes at least one transfer roller.

9. The continuously variable valve lift system of claim 8, wherein:

a transfer shaft connects the transfer roller and the lifter through the shaft hole of the upper body and a fourth slot formed on the lifter, wherein the transfer shaft is movable along the fourth slot.

10. The continuously variable valve lift system of claim 9, wherein the fourth slot is formed on the first hand of the lifter in a longitudinal direction thereof at distal end portion of the first hand of the lifter.

11. The continuously variable valve lift system of claim 9, wherein the fourth slot is positioned substantially above the drive shaft.

12. The continuously variable valve lift system of claim 1, wherein an input roller is disposed to a portion that the input cam contacts.

13. The continuously variable valve lift system of claim 12, wherein the input roller is disposed to a distal end portion of the second hand of lifter.

14. The continuously variable valve lift system of claim 11, wherein the controlling unit comprises a controlling motor.

* * * * *